US006582154B1

(12) United States Patent
Updyke et al.

(10) Patent No.: US 6,582,154 B1
(45) Date of Patent: Jun. 24, 2003

(54) REMOTE CONTROLLED CONCRETE POWER FLOAT

(76) Inventors: Julie Anne Updyke, c/o Cym Berth 202, #26, Wilmington, CA (US) 90744; Robert F. Updyke, 74577 Azurite Cir. East, Palm Dessert, CA (US) 92260

( * ) Notice: Subject to any disclaimer, the term of this patent is extended or adjusted under 35 U.S.C. 154(b) by 0 days.

(21) Appl. No.: 10/147,770

(22) Filed: May 17, 2002

(51) Int. Cl.[7] ..... E01C 19/22
(52) U.S. Cl. ..... 404/118; 404/133.1
(58) Field of Search ..... 440/37; 404/101, 404/118, 133.05, 133.1, 133.2

(56) References Cited

U.S. PATENT DOCUMENTS 2,341,911 A * 2/1944 Drexler et al. ..... 440/37
4,132,492 A 1/1979 Jenkins
4,371,287 A 2/1983 Johansson
4,421,489 A * 12/1983 Van Veldhuizen ..... 440/37
4,655,633 A 4/1987 Somero et al.
4,848,960 A * 7/1989 Kajioka et al. ..... 404/112
5,039,249 A 8/1991 Hansen et al.
5,288,166 A 2/1994 Allen et al.
5,328,295 A * 7/1994 Allen ..... 404/84.1
5,503,242 A * 4/1996 Jeffers ..... 180/182
6,106,193 A 8/2000 Allen et al.
6,139,217 A * 10/2000 Reuter ..... 404/97

* cited by examiner

*Primary Examiner*—Thomas B. Will
*Assistant Examiner*—Raymond W Addie
(74) *Attorney, Agent, or Firm*—Gene Scott-Patent Law & Venture Group

(57) ABSTRACT

A remotely controlled power float apparatus comprises a horizontally oriented platform supported on a pair of spaced apart, rotationally mounted, floats. The floats each provide a downwardly directed flat surface for moving in contact with, and thereby smoothing, a non-hardened concrete surface. Mounted on the platform is a fan, rotationally adapted for directing a horizontal thrust vector in a variably selectable direction for moving and steering the apparatus over the concrete surface. The floats are adapted for being tilted thereby enabling a variable contact area between the floats and the concrete surface.

6 Claims, 1 Drawing Sheet

REMOTE CONTROLLED CONCRETE POWER FLOAT

BACKGROUND OF THE INVENTION

INCORPORATION BY REFERENCE: Applicant(s) hereby incorporate herein by reference, any and all U.S. patents, U.S. patent applications, and other documents and printed matter cited or referred to in this application.

1. Field of the Invention

This invention relates generally to tools for smoothing and leveling poured concrete slabs and surfaces, and more particularly to a power float machine, remotely controlled, driven and steered by a fan and capable of tiling forward and aft floats upon which the machine is supported.

2. Description of Related Art

The following art defines the present state of this field:

U.S. Pat. No. 4,371,287—discloses and illustrates a surface laser controlled trowelling device. Refer to the Abstract; FIG. 1 and column 2, line 31 et seq. U.S. Pat. No. 4,132,492—discloses and illustrates a self-propelled concrete screed machine in which the prime mover is remotely operated. Refer to FIG. 2 (elements 12 and 162); column 2, line 13 et seq.; and claim 8. U.S. Pat. No. 5,288,166—discloses and illustrates a laser operated concrete finishing tool. Refer to the Abstract; FIGS. 1 and 2; and column 4, lines 48–52. U.S. Pat. No. 6,106,193—discloses and illustrates a concrete finishing device having a seated operator control station. Refer to the Abstract; FIG. 1 and column 6, line 26. U.S. Pat. No. 4,655,633—discloses and illustrates a screeding apparatus having a seated operating station. Refer to the Abstract; FIG. 2; and column 9, line 12 et seq. U.S. Pat. No. 5,039,249—discloses and illustrates a manually operated screeding device for concrete and the like. Refer to the Abstract and FIG. 1.

The prior art teaches troweling and screeding devices and machines including those controlled by a laser line and other relatively new technical methods, but does not teach a remotely operated and controlled concrete leveling and smoothing machine with fan drive and variable weight control. The present invention fulfills these needs and provides further related advantages as described in the following summary.

SUMMARY OF THE INVENTION

The present invention teaches certain benefits in construction and use which give rise to the objectives described below.

A power float apparatus comprises a horizontally oriented platform supported on a pair of spaced apart, rotationally mounted, floats. The floats each provide a downwardly directed flat surface for moving in contact with, and thereby smoothing, a non-hardened concrete surface. Mounted on the platform is a fan, rotationally adapted for directing a horizontal thrust vector in a variably selectable direction for moving and steering the apparatus over the concrete surface. The floats are adapted for being tilted thereby enabling a variable contact area between the floats and the concrete surface. The primary use of this invention is to level and vibrate a concrete surface after the screeding phase and before the surface is finished or polished. The invention replaces the well known hand operations using a bull float and the Fresno process. The invention is placed on the surface to be leveled by a hoist and operated, preferably by a hand-held remote control unit manipulated by a workman standing to one side of the surface being worked on.

A primary objective of the present invention is to provide an apparatus and method of use of such apparatus that provides advantages not taught by the prior art.

Another objective is to provide such an invention capable of smoothing freshly poured concrete.

A further objective is to provide such an invention capable of being controlled by a remotely located operator.

A still further objective is to provide such an invention capable of adjusting smoothing forces delivered to the concrete surface.

A yet further objective is to provide such an invention driven and steered by a angularly directable fan.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawing illustrates the present invention. In such drawing.

DETAILED DESCRIPTION OF THE INVENTION

Figure 1:
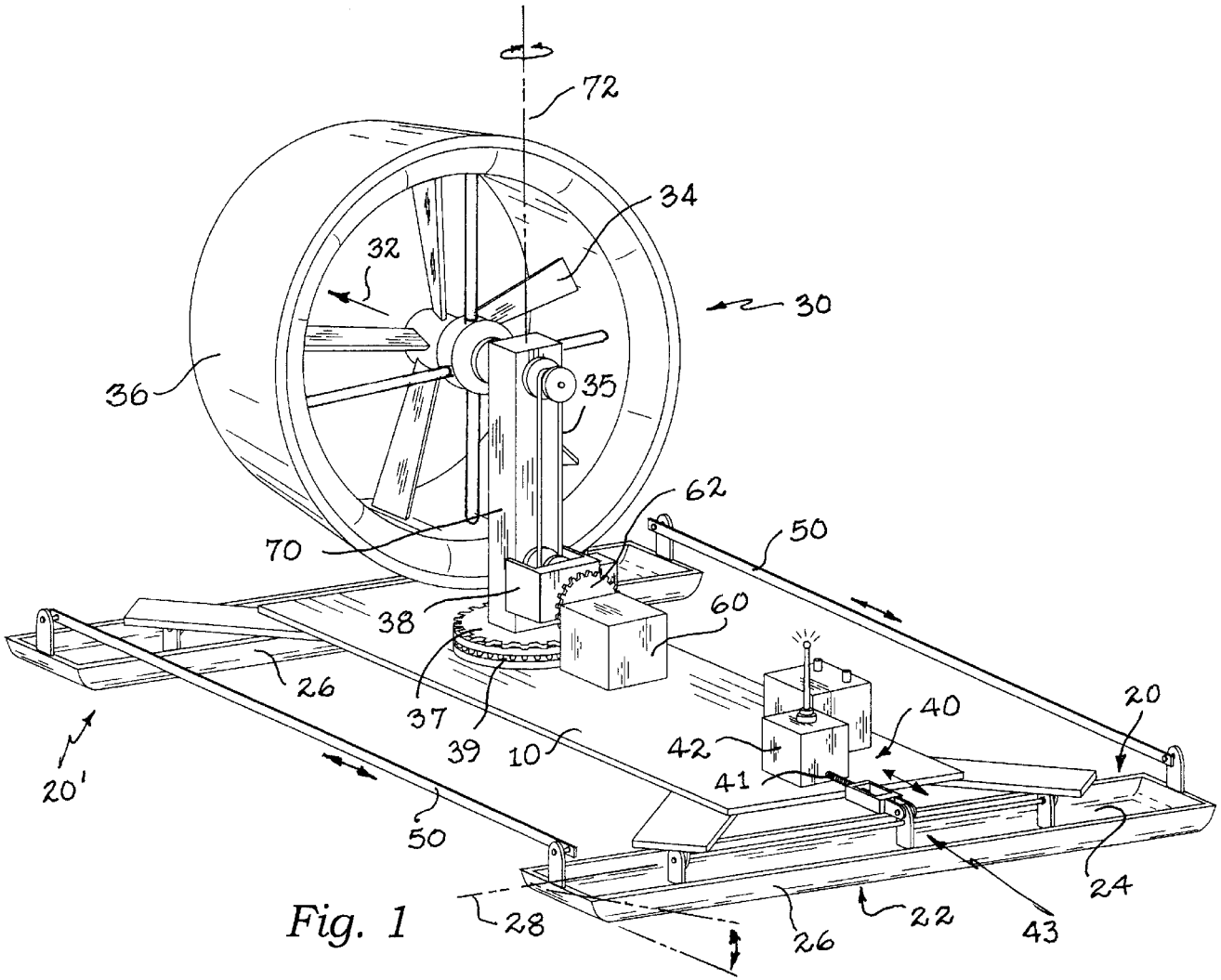
FIG. 1 is a perspective view of the preferred embodiment of the invention.

The above described drawing figures illustrate the invention in at least one of its preferred embodiments, which is further defined in detail in the following description.

The present invention is a power float apparatus including a horizontally oriented platform 10 supported on a pair of spaced apart, rotationally mounted, floats 20, 20'. The platform 10 and the floats 20, 20' are preferably made of steel, aluminum or similar structural materials.

Each of the floats 20, 20' provides a downwardly directed flat surface 22 for moving in contact with, and thereby smoothing and leveling, a non-hardened concrete surface. The concrete surface is not shown in the illustration. Mounted on the platform 10 is a fan 30, rotationally adapted for directing a horizontal thrust vector 32 in a variably selectable direction for moving and steering the apparatus over the concrete surface. This type of drive and steering system is well known in the swamp boats used in the Florida Everglades. A means for tilting 40 of the floats 20, 20' enables a variable contact area between the floats 20, 20' and the concrete surface. Each of the floats 20, 20' comprises a generally elongated horizontally oriented, planar, bottom panel 24 enclosed by a peripheral, upwardly extending sidewall 26 so that concrete cannot enter the floats 20, 20'. The fan 30 comprises a propeller 34 mounted within a surrounding fixed cowling 36, and a drive motor 38 engaged, by belt 35, with the propeller 34 for rotating it. Preferably this drive is set-up in such a manner as to vary the magnitude of the thrust vector 32 for controlling the speed by which the apparatus moves over the concrete surface. The tilting means 40 preferably comprises a tilt motor 42 engaged with one 20 of the floats 20, 20' so as to rotate it about a longitudinal axis 28. Such rotation need only be over a few degrees and causes the weight of the apparatus to be shifted to the rear edge of each the floats 20, 20'. A pair of push rods 50 is engaged between the floats 20, 20' for rotating the other 20' of the floats 20, 20' in correspondence with the driven one 20. The rods 50 are therefore rotationally coupled with the floats 20, 20' as is clearly shown in FIG. 1. By shifting the weight of the apparatus to the rear edges of the floats 20, 20' the force per square area applied to the concrete surface may be greatly varied, so that the apparatus is able to level a highly roughened surface quickly and also to accomplish fine smoothing as well. The engagement of the tilt motor 42 is preferably through worm gear 41 and linkage 43. The rotational adaptation of the fan 30 comprises a rotation motor 60 mounted on the platform and a support column 70 engaging the fan 30, drive motor 38, rotation gear 37, and a bearing 39, which enables rotation of the support column 70 about a vertical axis 72 so as to direct the propeller 34. The rotation gear 37 engages with the rotation motor 60, via motor gear 62, for directing the fan 30 and thereby, the thrust vector 32. The fan 30, tilting means 40 and rotation motor 60 are enabled for remote control, preferably by wave energy transmission, in a manner common to radio controlled aircraft which is well known in the art.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A power float apparatus comprising: a horizontally oriented platform supported on a pair of spaced apart, rotationally mounted, floats, wherein the floats each provide a downwardly directed flat surface for moving in contact with, and thereby smoothing, a non-hardened concrete surface; and, mounted on the platform, (a) a fan, rotationally adapted for directing a horizontal thrust vector in a variably selectable direction for moving and steering the apparatus over the concrete surface; and (b) a means for tilting of the floats, thereby enabling a variable contact area between the floats and the concrete surface.

2. The apparatus of claim 1 wherein each of the floats comprise a generally horizontally oriented, planar, bottom panel enclosed by a peripheral, upwardly extending sidewall.

3. The apparatus of claim 1 wherein the fan comprises a propeller within a surrounding cowling, and a drive motor engaged with the propeller for rotation thereof.

4. The apparatus of claim 1 wherein the tilting means comprises a tilt motor engaged with one of the floats so as to rotate the one of the floats about a longitudinal axis thereof; and a pair of push rods engaged between the floats for rotating the other of the floats in correspondence with the one of the floats.

5. The apparatus of claim 3 wherein the rotational adaptation of the fan comprises a rotation motor mounted on the platform; and a support column engaging the fan, the drive motor, a rotation gear, and a bearing enabling rotation of the support column about a vertical axis; the rotation gear engaged with the rotation motor for directing the fan and thereby, the thrust vector.

6. The apparatus of claim 5 wherein the fan, tilting means and rotation motor are enabled for remote control.

* * * * *